United States Patent [19]

Levine et al.

[11] 4,101,992

[45] Jul. 25, 1978

[54] SPRING ASSEMBLY WITH REINFORCEMENT

[75] Inventors: Alexander M. Levine, Boston; Henry R. Ramsey, Dudley, both of Mass.

[73] Assignee: Webster Spring Co. Inc., Oxford, Mass.

[21] Appl. No.: 769,460

[22] Filed: Feb. 17, 1977

[51] Int. Cl.[2] ..... F16F 3/00; A47C 23/02

[52] U.S. Cl. ..... 5/260; 5/247

[58] Field of Search ..... 5/247, 260–262, 5/267; 267/102

[56] References Cited

U.S. PATENT DOCUMENTS

| | | | |
|---|---|---|---|
| 3,612,505 | 10/1971 | Bond | 5/247 |
| 3,835,485 | 9/1974 | Klicki | 5/260 |
| 3,982,290 | 9/1976 | Ward | 5/260 |
| 3,990,121 | 11/1976 | Whitaker | 5/260 |
| 4,003,564 | 1/1977 | Taylor | 5/247 |

*Primary Examiner*—Casmir A. Nunberg

*Attorney, Agent, or Firm*—Dike, Bronstein, Roberts, Cushman & Pfund

[57] ABSTRACT

The combination with a spring assembly of pairs of structures designed to be applied transversely to the top and bottom supporting surfaces at one or more longitudinally spaced intervals to enhance resistance to sinking of the supporting surfaces, bowing at the longitudinal sides and collapse between the surfaces at the longitudinal sides due to pressure applied perpendicular to the supporting surfaces, said structures each comprising a stiff, inextensible wire of circular or flat cross section resistant to flexing and at one end a compression-resistant spring, said structures being disposed in pairs with the one structure crossing the top and the other crossing the bottom and with the compression-resistant spring of one situated between the supporting surfaces at one side and of the other situated between the supporting surfaces at the other side and fasteners connecting the structure to the assembly.

10 Claims, 14 Drawing Figures

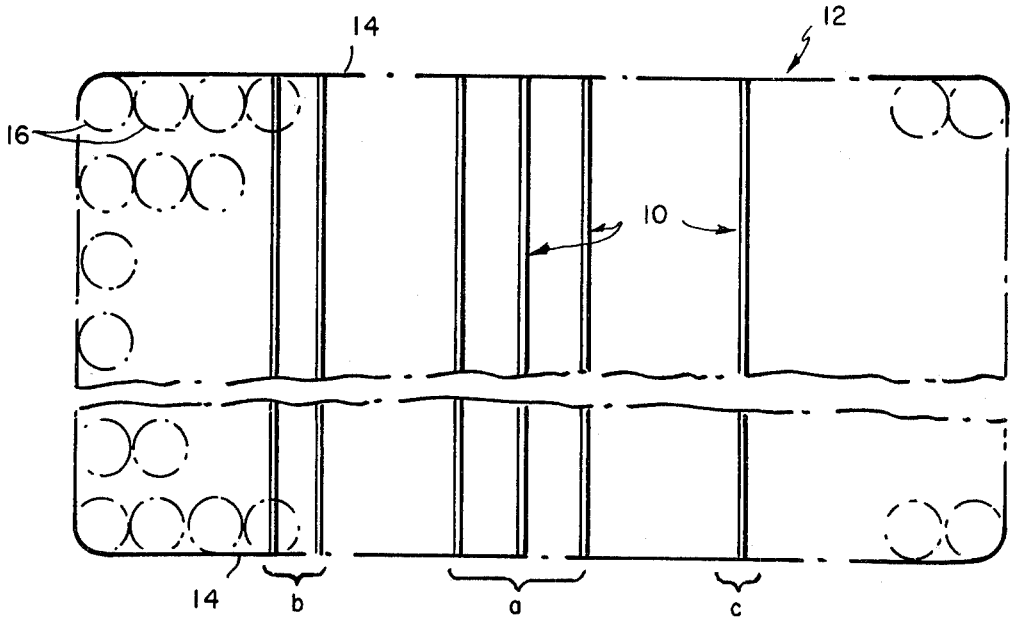
FIG. 1
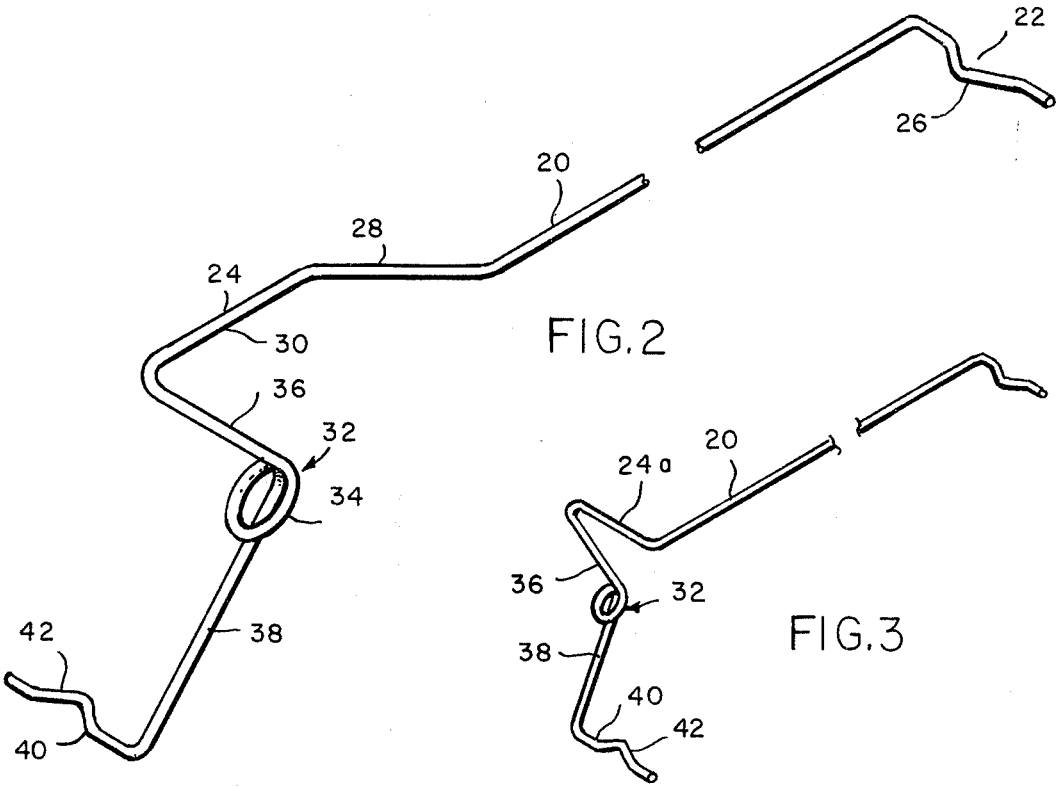
FIG. 2
FIG. 3

SPRING ASSEMBLY WITH REINFORCEMENT

BACKGROUND OF THE INVENTION

Reinforcement of innerspring assemblies is provided in many forms to firm up soft and/or poor-quality assemblies which have too few springs or too small gauge wires or to enable providing the desirable quality of firmness and durability without an excessive number of springs which complicate construction and increase the cost. Such devices have in the past been built into the assembly as the latter is constructed according to the specification of the manufacturer irrespective of and without opportunity on the part of the purchaser to decide where and how much reinforcement is desirable. The present invention is to provide structures which may be optionally applied to an already constructed spring assembly at one or more places according to customer wishes or which may be built into the assembly during construction of the latter according to customer specification which will add substantially to the comfort and appearance by minimizing sinking intermediate the longitudinal edges, bowing at the longitudinal edges and collapse of the longitudinal edges without involving time-consuming techniques and/or special machinery.

SUMMARY OF THE INVENTION

As herein illustrated, the invention resides in pairs of structures adapted to be applied to the opposite (top and bottom) supporting surfaces of a spring assembly transversely thereof at one or more longitudinally spaced intervals, each pair comprising a longitudinally inextensible stiff part (resistant to flexing) and means at one end thereof resistant to compression, said structures being disposed with the one part transversely of the supporting surfaces and with the compression-resistant means of one situated between the supporting surfaces at one longitudinal side and of the other at the other longitudinal side. The spring assemblies comprise spaced parallel border wires to which coiled springs are attached and the structures are connected at their ends to the border wires as, for example, by means of hog rings. For this purpose, the transverse parts have bent ends which parallel the border wires about which the hog rings can be crimped and the compression-resistant members similarly have bent portions which parallel the border wires about which hog rings can be clamped. The compression-resistant means are springs such as torsion springs and are connected in offset relation to the transverse parts which extend along the rows of coils so as to be situated between rows of coils, the spring at one end being between the next row at one side and the spring at the other end being between the next row at the other side of the row along which the traversing part extends. Each structure may comprise a pair of spaced parallel parts joined at one end and having at their other ends compression-resistant means in the form of a pair of torsion springs. The torsion springs may be of single or double loop and may be so arranged as to be disposed with their torsion-resistant arms in planes parallel to the transverse rows of coils or in the planes parallel to the side of the assembly. Optionally, a hairpin-type spring or zigzag spring may be substituted for the torsion coils. The bent end of the structures by means of which they are attached to the border wires may be optionally provided with crimps to prevent disengagement from the hog rings or similar clamping means for connecting the parts.

The invention will now be described with reference to the accompanying Figures, wherein:

FIG. 1 is a plan view of an innerspring assembly diagrammatically showing the border wire, spring coils and the structural elements of this invention which contribute to firming up the coil spring assembly applied at two or more places longitudinally of the assembly;

FIG. 2 is an isometric of one form of the structure which is to be applied to the spring assembly;

FIG. 3 is an isometric of a modified form of the structure;

The reinforcing structural elements 10 constituting the subject matter of this invention are designed to be applied to an innerspring mattress assembly to supplement the resistance to sinking of the supporting surface of the assembly intermediate the opposite longitudinal sides, to supplement the resistance to collapse at the opposite longitudinal sides and to supplement the resistance to inward bowing of the opposite longitudinal sides.

Referring to FIG. 1, several such structures 10 are shown applied transversely to an innerspring mattress assembly 12 at selected positions longitudinally of the assembly to provide the aforesaid supplementary resistance as, for example, in areas A and B where the assembly is most heavily loaded in use, these areas being located approximately at the places where the hips and shoulders rest. It is, of course, entirely possible and may be desirable to supplement the resistance of the spring assembly in other places as, for example, at C or to provide such supplemental reinforcement over the entire length of the assembly. The structure as will be described enables firming up an inner-spring assembly which has less than the desired resistance to sinking intermediate its sides and/or collapse at its opposite longitudinal sides and may be applied to an already constructed spring assembly to provide the aforesaid features or built into a spring assembly to provide the aforesaid features with a lesser number of coils or coils of smaller gauge wire without sacrificing the comfort and/or the durability of the spring assembly.

Figure 4:
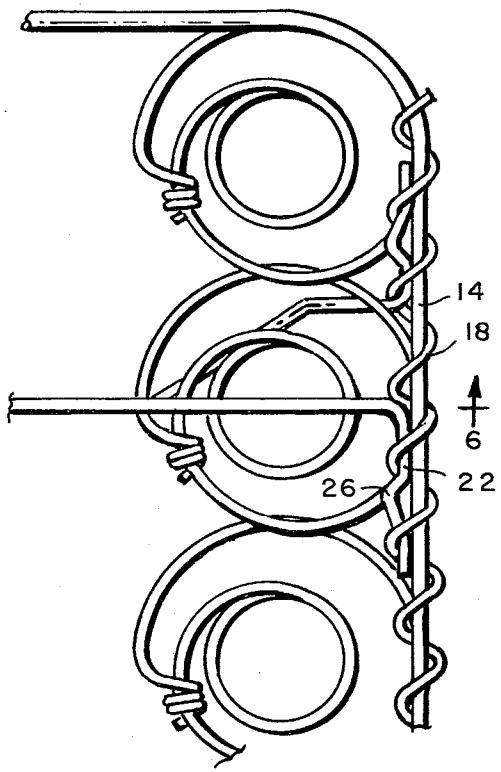
FIG. 4 is a plan view to much larger scale of the spring assembly showing the border wire, spring coils attached to the border wire and to each other with a structure such as shown in FIG. 2 secured transversely to the assembly between the border wires.
Figure 4:
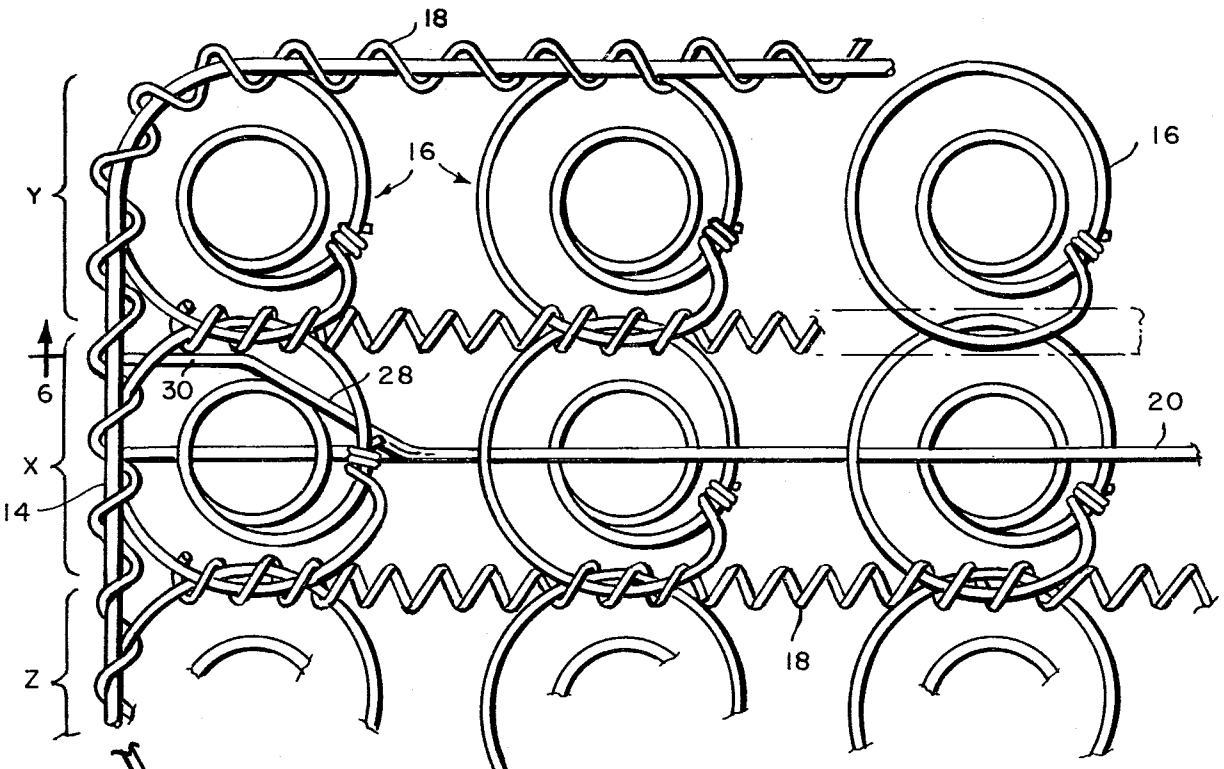

The spring assembly as shown in FIGS. 1 and 4 is of substantially rectangular configuration and comprises spaced parallel border wires 14—14 and coils 16 connected to the border wires at their upper and lower ends and to each other in longitudinally spaced transversely extending rows by spiral wrapping coils 18. Such structure is conventional in the art and the number of coils in a row and the spacing of the coils longitudinally of the structure, as well as the gauge of the wire of the coils, is a matter of choice and will depend to some extent upon the quality to be built into the innerspring assembly.

The reinforcing structures 10 are applied in pairs to the opposite supporting surfaces of the spring assembly along the upper and lower ends of the rows of coils and in one form as shown in FIG. 2, each structure 10 comprises a straight transversely elongate part 20 at the opposite ends of which there are oppositely bent portions 22 and 24. The bent portion 22 is bent substantially at right angles to the longitudinal axes of the part 20 and contains a deviation 26. The bent portion 24 comprises a part 28 bent laterally at an angle to the axis of the part 20 and a part 30 parallel to the axis of the part 20. The bent portions 22 and 24 lie in a common plane with the axis of the part 20 and at the end of the part 30 there is a torsion spring 32 comprising a coil 34 of one or more turns and arms 36 and 38 situated in a plane at right angles to the plane of the bent portins 22 and 24. The arm 36 is integral with the part 24 and the arm 38 has at its distal end a bent portion 40 containing a deviation 42.

Figure 5:
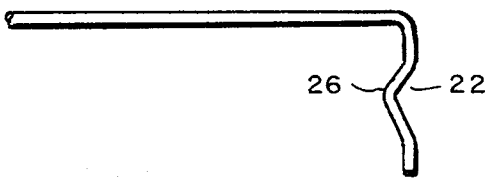
FIG. 5 is a view of the structure shown in FIG. 4 removed from the spring assembly in elevation.
Figure 5:
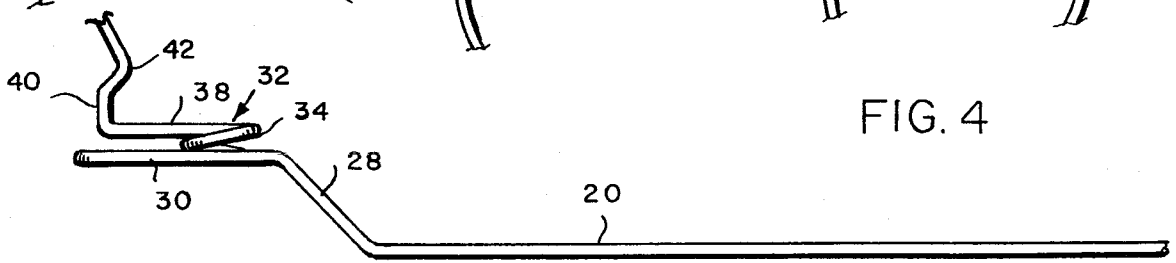
Figure 6:
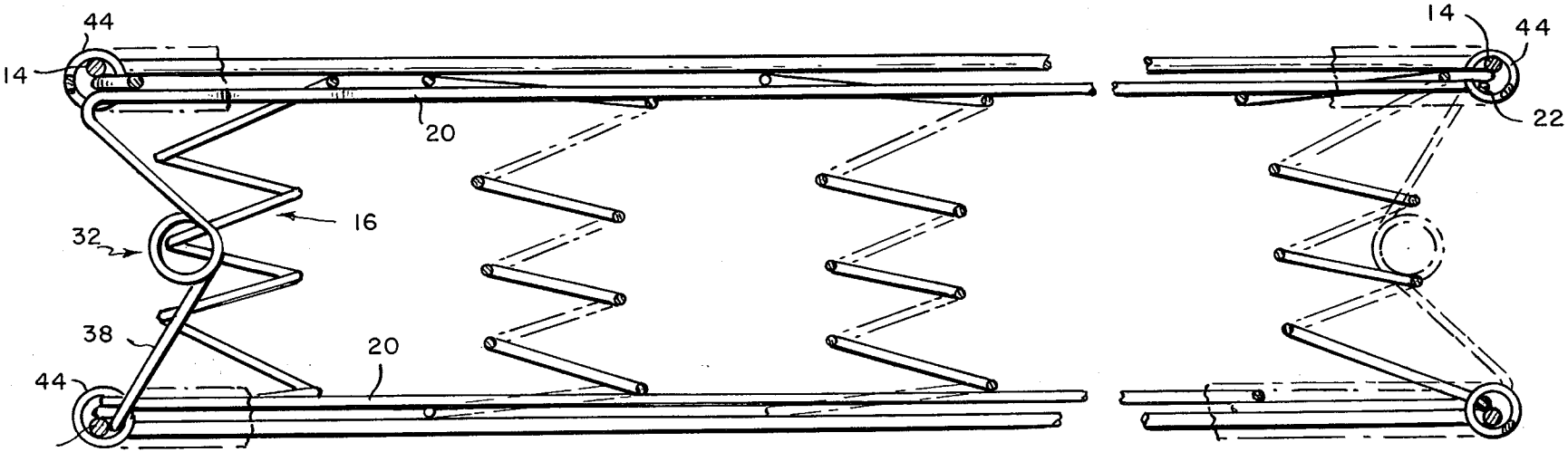
FIG. 6 is a view taken transversely of the spring assembly on the line 6—6 of FIG. 4.
Figure 7:
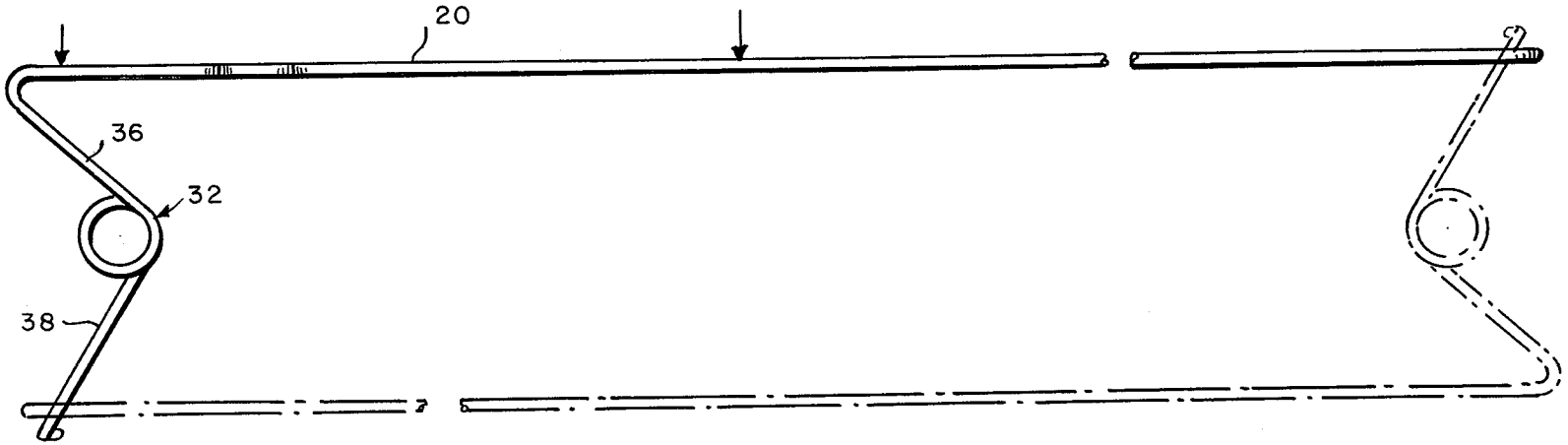
FIG. 7 is an elevation showing one of the structures in full lines removed from the spring assembly and the other in dot and dash lines showing their relation to each other.

The structures 10 are applied in pairs to the spring assembly transversely thereof as shown in FIG. 4 by inserting the right-hand end as shown in FIG. 2 through from the left-hand side of the assembly across the assembly along the upper ends of a row of the coils 16 to the right-hand side whereupon the bent portion 22 is engaged within the spiral wrapping coil 18 in parallel relation to the border wire at that side. At that position, the torsion spring 32, because of the laterally bent portion 24, will occupy a position between the upper and lower border wires, as shown in FIGS. 5 and 6 and in the space between the row of coils *x* along which the part 20 extends and the next transverse row of coils *y*. The bent portion 40 is interengaged with the spiral wrapping coil 18 of the lower one of the border wires and in parallel relation thereto. The deviations 26 and 42 of the bent portions 22 and 40, by interengagement with the spiral wrapping coil 18, resist disengagement of the bent portions from the spiral wrapping coil 18 and, hence, from attachment to the border wires. Additional means for attaching the structures to the border wires may be employed as shown, for example, in FIG. 6 in the form of hog rings 44 applied about the bent portion 22 and the border wire with which it is contiguous, at the junction of the portion 30 and the border wire and about the bent portion 40 and the border wire with which it is contiguous. Clips or other equivalent fastening means may be substituted for the hog rings.

The structures are mounted in pairs, as related above, and after inserting a structure 10 as just described from the left-hand side, a second structure is inserted from the right-hand side so that the portion 20 of the part inserted from the right-hand side is vertically spaced from the portion 20 inserted from the left-hand side. The bent part 22 extends in a direction opposite to the bent part 22 of the structure at the top side, the bent part 24 in a direction opposite to the bent part 24 of the structure at the top side and the torsion spring 32 is located between the upper and lower border wires in the space between the row of coils *x* along which the part 20 extends and the next row of coils *z*. The structures 10 are comprised of stiff wire of suitable cross section which may be circular or rectangular and, when the portions 20 are connected at their ends to the border wires as described, resist displacement of the border wires in either direction in the plane of the supporting surfaces of the assembly since the wire itself is longitudinally inextensible, and resist downward displacement by a load perpendicular to the supporting surface because of its resistance to flexing. The tension springs at the ends resist collapse at the longitudinal sides. By placing the structures in pairs with the coil springs disposed at opposite sides, a balanced threefold stabilizing support is provided.

The bent part 24 shown in FIG. 2 as described comprises a part 28 and a part 30 which makes the transition from the axis of a part 20 to the space between adjacent rows of coils at less than 45°. It is within the scope of the invention, however, to extend the portion 20 all the way across as shown in FIG. 3 to provide at the end a right angle bend **24*a* and to connect the spring 32 to the right angularly bent portion 24*a*. Since the bent part 24*a*** is parallel to the border, it can be easily connected thereto by means of a hog ring.

A modified form of the reinforcing structure is shown in FIGS. 8, 9, 10 and 11 wherein each structure 44 comprises spaced parallel transversely extending parts 46—46 connected at one end by a part 48 and provided at their opposite ends with oppositely bent portions 50—50 to which are connected torsion springs 52—52, each comprising a coil 54 of one or more turns and arms 56 and 58. The arms 56 are integral extensions of the parts 50—50 and the distal ends of the arms 58—58 are connected by a part 60 parallel to the bent ends 50—50. Two such structures 44 are inserted, one from the left-hand and one from the right-hand side, transversely of the assembly to a position of engagement of the part 48 with the border wires, FIGS. 8 and 9, and connected thereto by hog rings 62. When so positioned with the wires 46—46 at opposite sides of the centers of the coils along the row of coils, the torsion springs 52—52 will lie at opposite sides of that row within the opening between the adjacent rows of coils at each side. Hog rings 62 are used to connect the portions 50—50 to the border wires with which they are contiguous and hog rings 62 are used to connect the portions 60 to the lower border wires with which they are contiguous. This structure, because of the pairs of wires 46—46 at each side (top and bottom), affords an increased amount of resistance to sink at the center, and bowing and collapse at the longitudinal sides. In addition, this structure is somewhat easier to apply.

Figure 8:
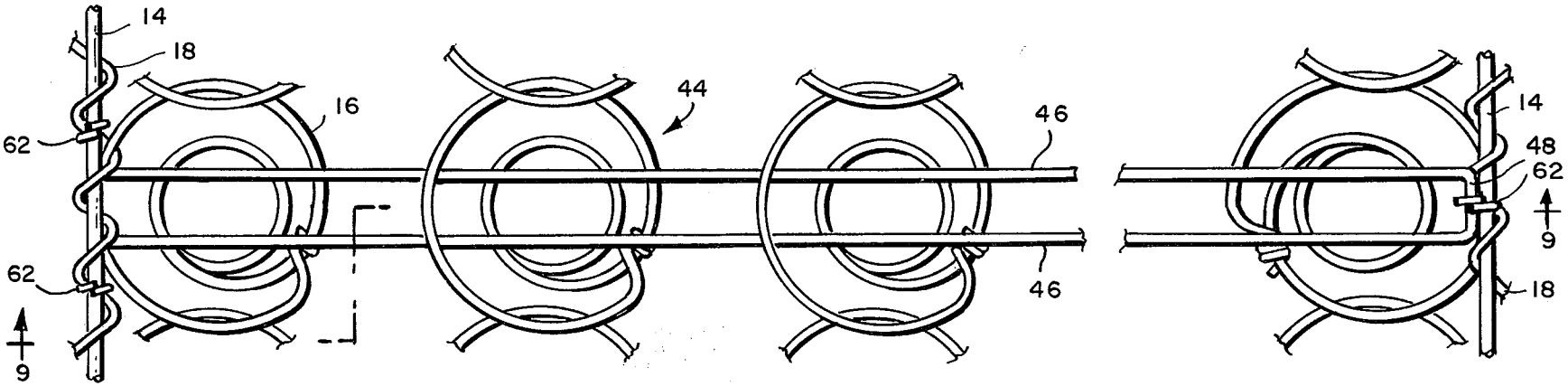
FIG. 8 is a fragmentary plan view of a spring assembly such as illustrated in FIG. 4 with a second alternative form of structure.
Figure 9:
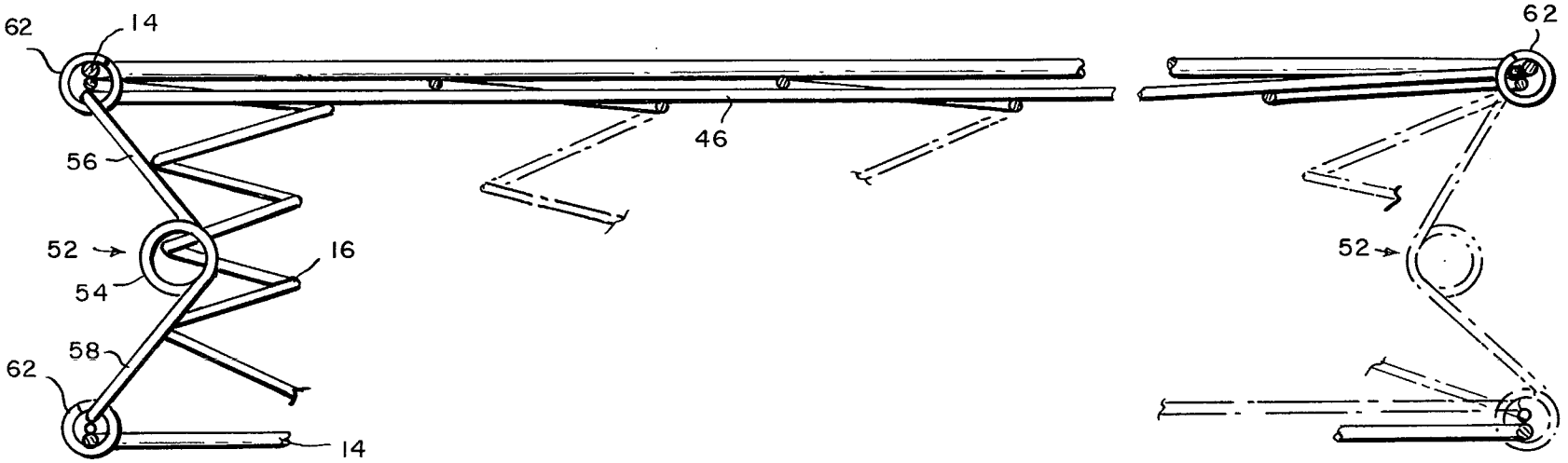
FIG. 9 is a transverse section taken on the line 9—9 of FIG. 8.
Figure 10:
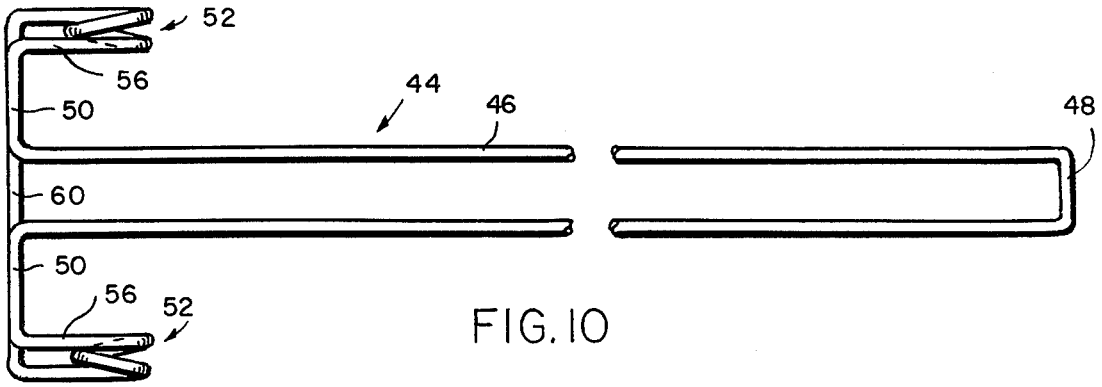
FIG. 10 is a plan view of the structure shown in FIGS. 8 and 9.
Figure 11:
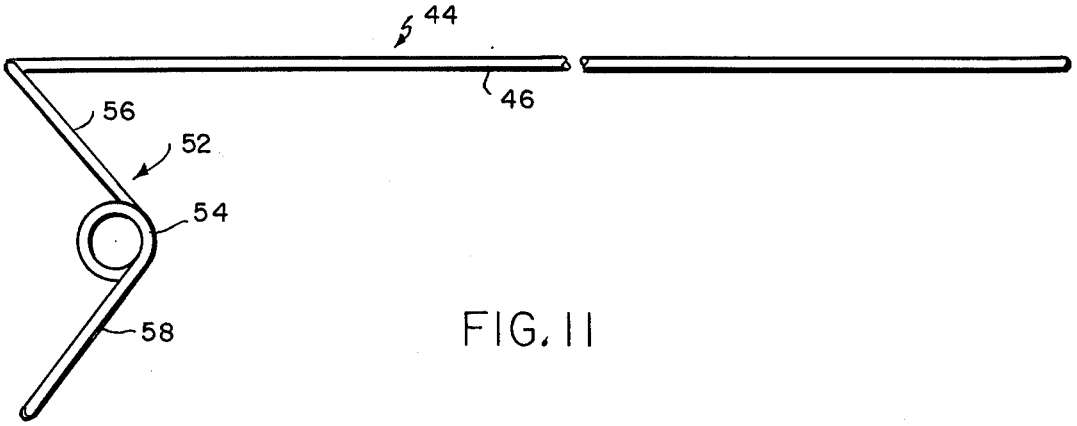
FIG. 11 is an elevation of the structure shown in FIG. 10.

As shown in both FIGS. 3 and 8, the transversely extending portion of the structure may be woven so as to overlie and underlie the upper ends of adjacent coils in the row of coils transversely of the structure. Such threading of the structure serves to maintain its position in alignment with the upper ends of the coils in the row and by its frictional engagement with the coil structure, enhancing its function.

Figure 12:
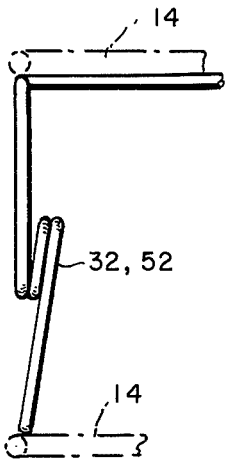
FIG. 12 is a fragmentary elevation showing the torsion spring coil disposed in a plane parallel to the edge of the assembly with its torsion axis parallel to the transverse rows of the coils.
Figure 13:
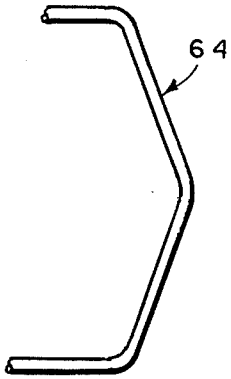
FIGS. 13 and 14 show alternate forms of compression-resistant springs which may be substituted for the torsion springs.
Figure 14:
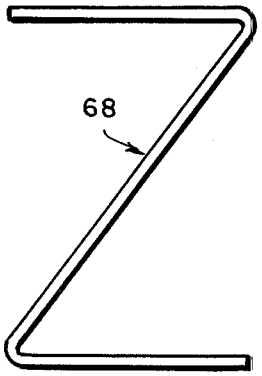

The torsion springs 32 and 52 are shown so attached to the transversely extending portions 20,46 that their arms lie in planes perpendicular to the planes of the supporting surfaces and with the axes of their coils parallel to the longitudinal sides of the spring assembly. The torsion coils, however, may be disposed with their arms parallel to the longitudinal sides of the spring assembly with their axes perpendicular to these sides, as shown in FIG. 12. Additionally, while a torsion spring of one or more coils is illustrated in the aforesaid Figures, a single bent spring 64 may be substituted therefor or a zigzag spring 68, FIGS. 13 and 14.

If the springs are disposed with their arms parallel to the longitudinal edges of the spring assembly, they place the resistance to downward displacement and collapse substantially in the planes of the sides where the pressure is greatest and, hence, can be more effective than when the springs are disposed with their coils inwardly of the sides. This structure also has the further advantage in that it provides side supports in the plane of the longitudinal sides for the covering.

The primary consideration is to provide a structure which embodies the three-fold functions of resisting sinking at the center of the supporting surfaces, bowing at the opposite sides, and collapse at the sides, and it is considered that any such structure, whether of single or multiple wire construction, is embodied within the scope of this invention.

It is to be understood that while the transverse portions of the structures are described as inextensible, they are conversely axially incompressible so that they act as struts which not only prevent bowing of the sides outwardly, but bowing of the sides inwardly.

The structures have been described as composed of wire such as is conventionally used by spring manufacturers for making springs, however, it is within the scope of the invention to employ plastics extruded in the form of wire of suitable cross section.

It should be understood that the present disclosure is for the purpose of illustration only and includes all modifications or improvements which fall within the scope of the appended claims.

I claim:

1. In a spring assembly including upper and lower border wires of rectangular configuration and a plurality of longitudinally spaced transversely extending rows of coils, said coils being connected at their upper and lower ends to the border wires and to each other; pairs of elongate stiffening elements disposed transversely of the assembly along the top and bottom ends of the coils in a row of coils, said stiffening elements being inextensible and affording resistance to deflection perependicular to the planes of the border wires and a torsion spring at one end of one element and at the other end of the other element situated between the border wires at the longitudinal sides, said torsion springs being resistant to compression perpendicular to the assembly, means connecting the torsion springs to the ends in laterally offset planes parallel to the elements and at distances therefrom so as to be situated in the spaces between rows of coils, means connecting each stiffening element to the transversely spaced border wires of the supporting surface in which it is situated and means connecting each torsion spring to the vertically spaced border wires at the longitudinal edges, said torsion springs being connected to the top and bottom border wires.

2. A spring assembly according to claim 1 wherein the stiffening elements have straight portions which extend from side to side along the ends of the coils and oppositely bent end portions and the torsion springs are connected to the bent end portions.

3. A spring assembly according to claim 2 wherein the axes of the springs are parallel to the sides of the assembly.

4. A spring assembly according to claim 2 wherein the axes of the springs are perpendicular to the sides of the assembly.

5. A spring assembly according to claim 2 wherein said stiffening elements comprise at each face pairs of spaced parallel elongate wires, said wires at one end being connected and means connecting the connected ends to the border wires and compression-resistant springs at the other ends of the wires disposed in oppositely offset relation to the wires at positions such as to be situated in the aisles between rows of coils and means connecting the upper and lower ends of the coils to the upper and lower border wires.

6. A spring assembly according to claim 1 wherein one or more pairs of means are secured to the supporting surfaces at the longitudinally spaced intervals where the assembly is loaded most heavily in use.

7. A spring assembly according to claim 1 wherein one or more pairs of means are attached to the assembly in the region that the hips of the person resting on the assembly would normally occupy.

8. A spring assembly according to claim 1 wherein one or more pairs of means are attached to the assembly in the region that the shoulders of the person resting on the assembly would normally occupy.

9. A spring assembly according to claim 1 wherein said means may be applied and fastened to the assembly of an already constructed assembly.

10. A spring assembly according to claim 1 wherein said means extend along the upper and lower ends of the coils of a row of coils and are interlaced with the end loops thereof.

* * * * *